United States Patent [19]

Ohe

[11] 4,419,920

[45] Dec. 13, 1983

[54] APPARATUS FOR RECORDING AND REPRODUCING MUSICAL PERFORMANCE

[75] Inventor: Ichiro Ohe, Hamamatsu, Japan

[73] Assignee: Nippon Gakki Seizo Kabushiki Kaisha, Hamamatsu, Japan

[21] Appl. No.: 396,360

[22] Filed: Jul. 8, 1982

[30] Foreign Application Priority Data

Jul. 16, 1981 [JP] Japan ..... 56-111429
Jul. 21, 1981 [JP] Japan ..... 56-114246
Jul. 23, 1981 [JP] Japan ..... 56-115560

[51] Int. Cl.[3] ..... G10F 1/00

[52] U.S. Cl. ..... 84/115; 84/1.18; 358/319; 358/143; 360/79

[58] Field of Search ..... 84/115, 1.03, 1.18; 358/145, 143, 310, 319, 339, 341, 343; 360/40, 79, 12

[56] References Cited

U.S. PATENT DOCUMENTS 4,361,852 11/1982 Katzfey ..... 358/145

4,363,255 12/1982 Brush ..... 84/115 X

*Primary Examiner*—Elliot A. Goldberg
*Assistant Examiner*—Derek Jennings
*Attorney, Agent, or Firm*—Spensley, Horn, Jubas & Lubitz

[57] ABSTRACT

Not only an image signal of a scene of performance of musical instruments and a sound signal of such performance, but also the performance data of a specific musical instrument are recorded by a video system, and by virtue of a reproduction of this record, the image signal, the sound signal and the performance data are separated from each other. Thus, not only the image from the image signal and the electronically reproduced sound from the sound signal, but also a real automatic playing musical instrument such as player piano corresponding to said specific musical instrument is actually driven to effect a performance, whereby the watcher-listener is also able to listen to the performance sound of a real musical instrument.

14 Claims, 9 Drawing Figures

APPARATUS FOR RECORDING AND REPRODUCING MUSICAL PERFORMANCE

BACKGROUND OF THE INVENTION (a) Field of the Invention

The present invention pertains to an apparatus for recording and reproducing images and sounds of a musical performance, and more particularly it relates to such apparatus as mentioned above which takes a record of image informations of a preformance scene and sound informations of such performance or demonstration, and which faithfully reproduces these recorded image-and-sound informations.

(b) Description of the Prior Art

There has been already put to practice the art of photographying, by a video camera, a scene of performance of, for example, an orchestra or ensemble and of making a detection of the sound of such performance in two channels, and of recording the photographed image signals and also the two-channel sound signals on a recording medium such as a video tape or a video disc. The image signal and the sound signal which have been recorded on such recording medium can be enjoyed simultaneously by the user in two ways, one of which is to watch the reproduced scene of performance and the other is to listen to the reproduced sound of, for example, the orchestra. Such system can be effectively utilized in musical education.

Also, it has been known in the past to form an image signal containing 2-channel sound signals and a one-channel image information. Such image signal has been recorded by a video tape recorder (VTR) or by a video disc system. In case of a musical performance by, for example, an orchestra, the sound of the performance is reproduced stereophonically in high quality together with the image of the performance.

However, such reproduction of a music sound by the use of such video system as described above has been limited strictly to an electronic reproduction, i.e. the sound is produced through a loudspeaker or loudspeakers, and the reproduced sound is an electrified sound and not a real sound. It has not been possible to reproduce the recorded sound directly through an actual play of a certain musical instrument or instruments constituting the orchestra.

SUMMARY OF THE INVENTION

It is, therefore, a primary object of the present invention to provide an apparatus for recording and reproducing the images and sounds of a musical performance, which apparatus being arranged to allow a listener-and-watcher to listen, on the one hand, to an actual play of a certain musical instrument when the music is reproduced, in place of listening to an electrified musical sound of this specific musical instrument pronounced through a loudspeaker, thereby materializing a reproduction of a substantially real scene and sound of performance, so as to be usable effectively in musical education also.

Another object of the present invention is to provide an apparatus of the type as described above, which is arranged so that the performance data of at least a certain musical instrument is stored, and that, at the time of reproduction, the specific musical instrument is controlled of its actual performance based on the recorded performance data thereof, whereby the performance scene can be visualized on a screen and simultaneously the sound of the performance of said musical instrument which was played at the scene can be reproduced as an actual play of the instrument.

Still another object of the present invention is to provide an apparatus of the type as described above, which is arranged so that, at the time of taking a record of a performance scene and sound, the performance data also of at least a certain musical instrument such as a player piano played at the scene is stored, and that, at the time of later reproduction, an automatic playing musical instrument such as said player piano is driven based on the recorded performance data, thereby permitting the listener to enjoy also an actual performance sound of the specific musical instrument during the whole reproduction.

A further object of the present invention is to provide an apparatus of the type as described above, which is arranged so that, at the time of taking a record of a performance scene and sound, the performance data of at least a certain musical instrument is also stored, and that, at the time of reproduction, the performance data can be selectively displayed on a cathode ray tube or television screen.

DETAILED DESCRIPTION OF THE PREFERRED EMBODIMENTS

Figure 1:
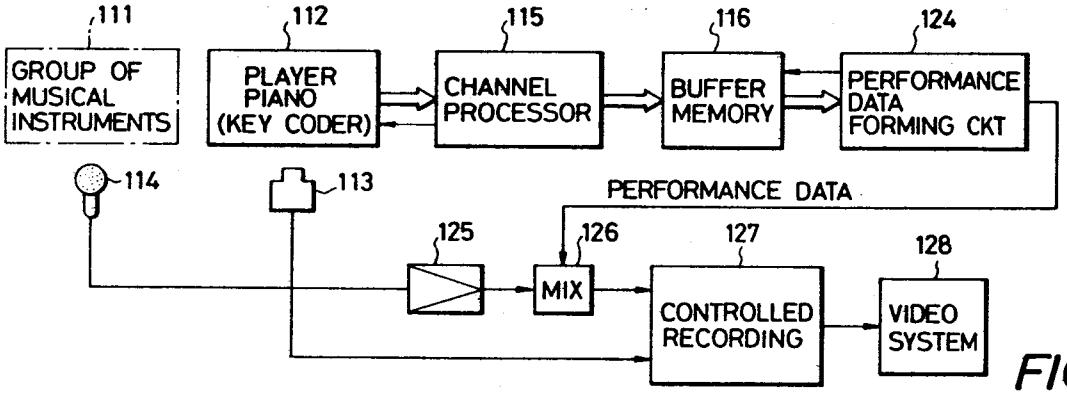
FIG. 1 is a block diagram for explaining the arrangement of the recording section of the apparatus for recording and reproducing a performance according to an embodiment of the present invention.
Figure 2:
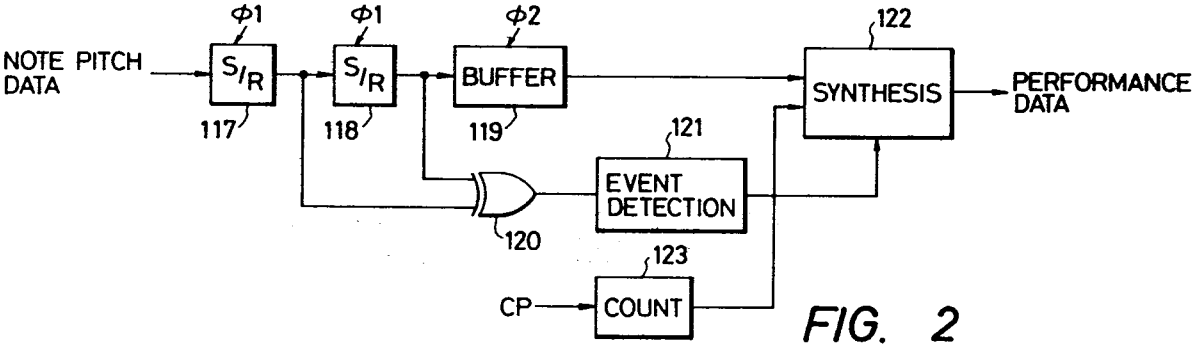
FIG. 2 is a block diagram for explaining the means of said apparatus for forming the performance data.
Figure 3:
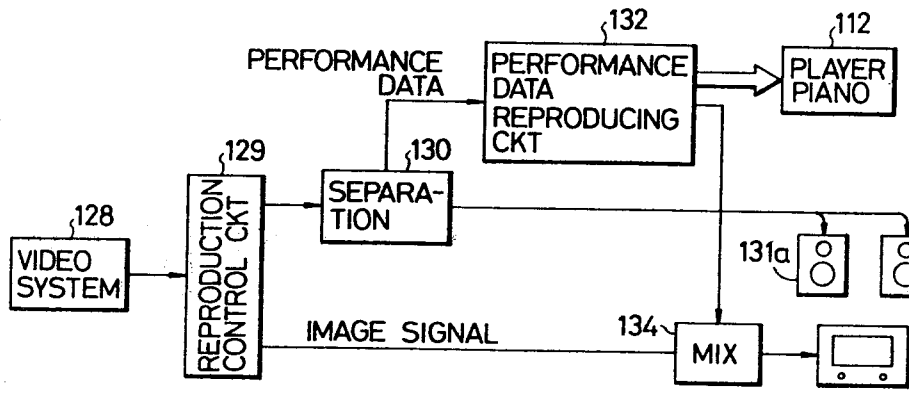
FIG. 3 is a block diagram for explaining the arrangement of the reproducing section of the apparatus mentioned above.

FIGS. 1 to 3 show an embodiment of the apparatus for recording and reproducing a performance according to the present invention.

In FIG. 1 which shows the recording section of the apparatus, there are disposed a group of musical instruments at 111 of, for example, an orchestra, along with a player piano 112 whose performance information is to be taken, to thereby make it possible to make an orchestra or ensemble performance by the group 111 of musical instruments and the player piano 112. In such orchestra performance, the player piano 112 is not played automatically, but it is actually played by a pianist. And, the scene of performance of the group 111 of musical instruments and of the performance of the player piano 112 is photographed by a video camera 113. On the other hand, the sound of musical performance by the group 111 of musical instruments is detected, for example, stereophonically in two channels by microphones 114 in such way that the sound of the piano being played is excluded from being picked up by microphones, and only the sounds of the other musical instruments are picked up into a 2-channel sound signal. Such recording is possible for example by an appropriate setting of the microphones though the sound of the piano will not be excluded completely. Another method is to videotape and/or record the piano performance and the other musical instruments performance in different rooms in a recording studio. This method enables to completely exclude the piano sound while the images of the piano and the other instruments will not be simultaneously appeared in a same picture when reproduced. Still another approach for the purpose to exclude the piano sound upon reproduction is to stereophonically record the sounds of the orchestra including a piano which is located in the center of the orchestra, i.e. the center of the right channel and left channel microphones. When reproducing the sound signals thus recorded, the R channel signal is phase-inverted and mixed with the L channel signal while the L channel signal is phase-inverted and mixed with the R channel signal. As a result, the sound signal located in the center is cancelled out since this signal is equally contained both in the R and L channels. The sound signals of the instruments located out of the center are not cancelled since their signal levels in the R and L channels are different.

In the player piano 112, the note pitch data of those keys which are operated (depressed) are generated sequentially by a key coder in digital form in accordance with the progress of operation of the keys by the pianist. This digital data is constituted by a combination of, for example, an octave code and note (note name) code. In such musical performance which is to be recorded, the keys of the player piano 112 are operated usually by the fingers of both hands of the pianist, so that a plurality of keys are operated simultaneously, and thus a plurality of note data are generated. Accordingly, these plurality of note data are detected respectively by a channel processor 115, and they are assigned to respective note data processing channels and the note pitch data of the plural channels are buffer-stored, respectively, by a buffer memory 116. Since the contents of the key coder and the channel processor are well known in the electronic musical instrument field, their detailed description is omitted.

FIG. 2 shows an example of arrangement of those portions of the channel processor 115 and of the buffer memory 116 corresponding to a certain single channel. The note pitch data corresponding to a single key operation on the player piano 112 and being distributed in the channel processor 115 is stored in a first shift register 117 which is driven by a system clock pulse $\phi_1$. And, the note pitch data which has been stored in this first shift register 117 will further become stored in a second shift register 118 which is driven also by a system clock pulse $\phi_1$. The note pitch data which has been stored in the second shift register 118 is stored in a buffer 119 by a system clock pulse $\phi_2$ which differs in phase from the clock $\phi_1$.

Here, the note pitch data which has been stored in the first and second shift registers 117 and 118 are supplied to an exclusive OR circuit 120, so that in case there is present a difference in the contents of the data stored in these two shift registers 117 and 118, an output signal "1" is generated from the exclusive OR circuit 120. That is, when a fresh note pitch data is inputted to said channel by a fresh key operation, or when the inputted note pitch data is extinguished due to a release of a key corresponding to the note pitch data which has been inputted already by that time, an output signal "1" is generated from the exclusive OR circuit 120, so that a variation of the state of key operation, i.e. an event, is detected by an event detecting circuit 121.

The note pitch data which is stored in said buffer 119 is supplied, together with the event detection signal, to a synthesizing circuit 122. Also, to this synthesizing circuit 122 is supplied a count value data delivered from a counting circuit 123 which is driven to count by a clock pulse CP, that is a time data is supplied thereto. The synthesizing circuit 122 makes detection of a variation of the note pitch data by virtue of the event detection signal, and the result of this detection, along with its time data, is supplied as a performance data (information) to a performance data forming circuit 124.

It is to be understood, therefore, that the note pitch data corresponding to those operated keys is distributed in a plurality of channels which are set in the channel processor 115 in correspondence to the key operations on the player piano 112, and they are stored in the buffer memory 116, respectively. And, the resulting note pitch data is each formed into a performance data in correspondence to events, and the latter is outputted from the performance data forming circuit 124 in sequence of, for example, the order of the channels. The performance data delivered from the performance data forming circuit 124, along with the 2-channel sound signal delivered from the microphone 114, are jointly supplied to a mixing circuit 126 wherein the sound signal and the performance data are mixed together and synthesized into a composite signal by, for example, appropriate modulation. The resulting synthesized signal, together with an image signal delivered from the video camera 113, is supplied to a storage controlling circuit 127. This storage controlling circuit 127 causes a video system 128 to take a record of a synthesized signal of the sound signal and also the performance data along with the image signal. The video system 128 is comprised of such device as a video tape recorder or a video disc device.

FIG. 3 shows an arrangement of the reproducing and performing section which utilizes the image signal and the synthesized signal which have been thus recorded or stored. The recorded signal in the video system 128 is read out by a reproduction controlling circuit 129, and it is separated into an image signal and a synthesized signal. And, the synthesized signal, in turn, is further separated by a separating circuit 130 into a sound signal and a performance data. The sound signal is led to a sound reproducing mechanisms 131*a* and 131*b* which includes 2-channel loudspeakers to stereophonically reproduce the performance sound made by the group 111 of musical instruments and which has been detected by said microphone 114.

Also, the performance data which has been so separated by the separating circuit 130 is supplied to a performance data reproducing circuit 132 to drive pertinent keys of the player piano 112 in correspondence to the note pitch data which has been reproduced by the reproducing circuit 132 and also to their associated events, to thereby cause the player piano 112 shown in FIG. 1 to automatically reproduce the performance as already recorded, whereby permitting the listener-and-watcher to directly hear the performance sound produced by the player piano per se, along with the electronically processed and reproduced performance sound delivered from the sound reproducing mechanisms 131*a* and 131*b*.

The image signal derived from the reproduction controlling circuit 129 is one which is reproduced basically as a screen image by a cathode ray tube (CRT) system 133 such as a television receiver. However, in this embodiment, the performance data reproducing circuit 132 mixes its performance data with the image signal by means of a mixing circuit 134. And, the CRT system 133 functions so that the scene of performance of the group of musical instruments which has been photographed by the video camera 113 can be displayed on a screen of the CRT system 133 along with the performance data which is displayed, for example, on a score superimposed on the screen by relying on a television opaque projecting (TELOP) technique.

Thus, by so arranging the whole apparatus as stated above, let us assume that a musical performance such as a piano concerto or ensemble is played actually, and that this performance is recorded by a video system 128. When this video record is reproduced, the music sound of the piano which is an important part of the orchestra for example is then played actually with an appealing reality by a player piano 112, while the performance by the other musical instruments of the orchestra is reproduced stereophonically through the 2-channel loudspeakers of the apparatus. And, it is possible for the watcher-listener to listen to the music play and concurrently also enjoy the scene of performance of the orchestra in a state quite close to that obtained when the listener-watcher actually attends the concert, since the scene of performance is displayed on the screen of the CRT unit 133. Not only that, a very substantial effect can be obtained from the viewpoint of musical education.

In such reproduction, if for example the data of the automatic playing of the player piano 112 which is delivered from the performance data reproducing circuit 132 is cut off, and the piano is played actually by a person based on the score which is being "telopped" progressively on the screen of the CRT unit 133 as the music advances, it is possible to make an exercise of piano playing as if in concert with an orchestra which can be observed on the screen by the piano player himself while playing the piano. Thus, there can be materialized an effective exercise in such form that can never be attained in the prior art, and this is remarkably effective in the education and learning of operation of a musical instrument.

Description has been made with respect to an embodiment wherein the sound performance data delivered from a player piano is synthesized into the other instruments sound signal. It should be understood, however, that such arrangement of the system may be modified so that the performance data may be varied appropriately, or the blanking period of a video signal may be appropriately utilized to effect a synthesis of the performance data for an image signal which is to be recorded on a video system.

Figure 4:
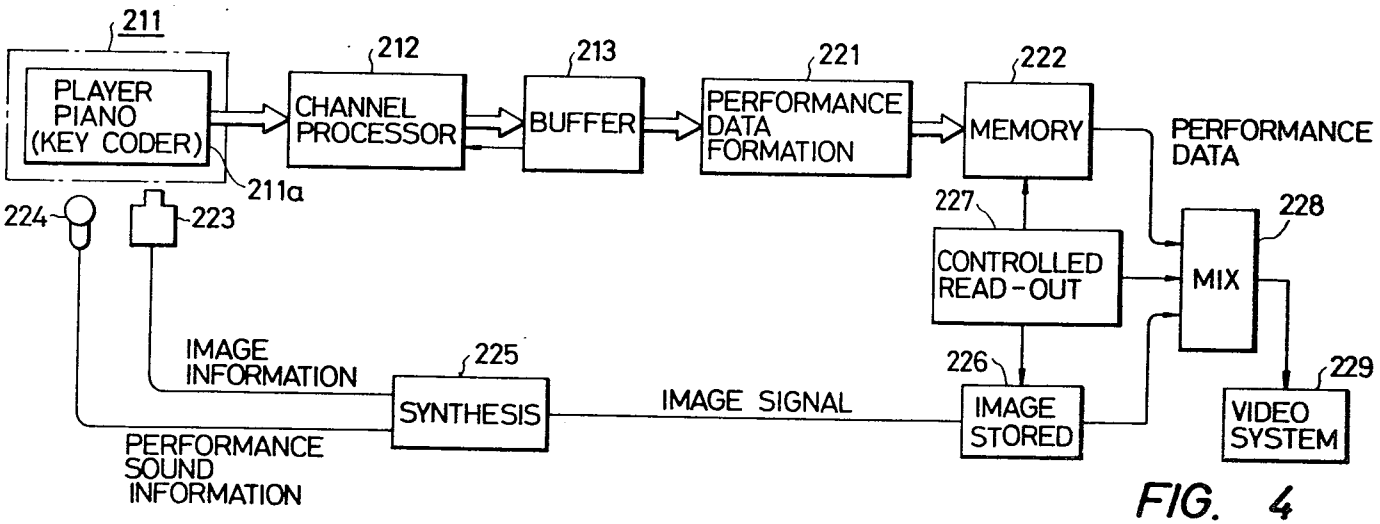
FIG. 4 is a block diagram for explaining the recording section of the apparatus for recording and reproducing a performance according to another embodiment of the present invention.
Figure 5:
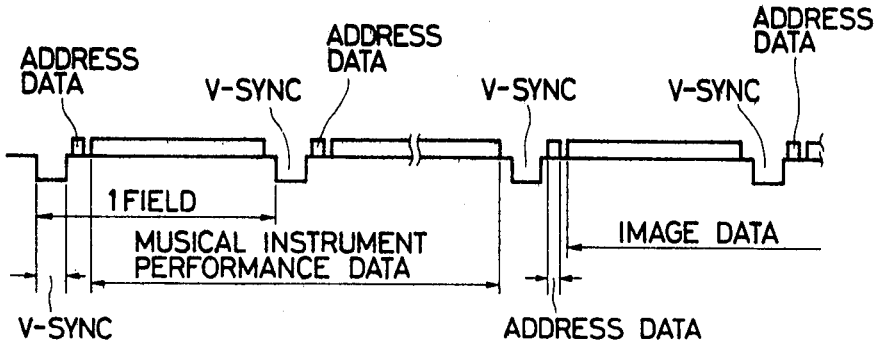
FIG. 5 is a chart for explaining the format of an image signal which is recorded in the recording section shown in FIG. 4.
Figure 6:
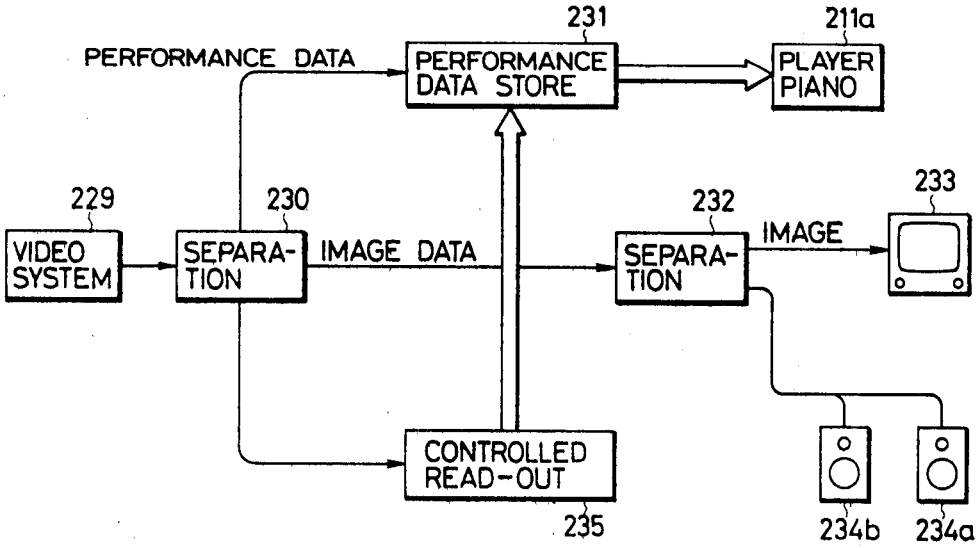
FIG. 6 is a block diagram showing the arrangement of the reproducing section for reproducing the record taken by the recording section shown in FIG. 4.

FIGS. 4 to 6 show another embodiment of the apparatus for recording and reproducing a performance which features that the manner of recording the performance data is modified. In FIG. 4 showing the recording section of the apparatus, there is set a player piano 211*a* which is included in a group 211 of musical instruments to go with the piano 211*a* and which is played by a pianist. From this piano 211*a* is generated, for example, a note pitch data corresponding to the note pitch of the operated key in accordance with the operation of a key. This note pitch data is constituted by a combination of, for example, a 2-bit octave code and a 4-bit note (note name) code. Since the piano 211*a* is such that its key operation is performed by fingers of both hands of the pianist, there may be the instance wherein a plurality of keys are operated simultaneously. In such an instance, the note pitch data corresponding to each of these operated keys is generated in parallel fashion with the data of the other depressed keys. The note pitch data generated from this player piano 211*a* are supplied to a channel processor 212. In this channel processor 212, there are set a plurality of channels, and the note pitch data which is generated from the player piano 211*a* is distributed to a non-occupied channel or channels in correspondence to, for example, the order of generation of the note pitch data, and these distributed note pitch data in the plural channels are buffer-stored respectively in a buffer memory 215. In the instant embodiment, as in the preceding embodiment, those parts of the channel processor 212 and the buffer memory 215 which correspond to a single channel are of a circuit arrangement same as that shown in FIG. 2.

In this instant embodiment also, arrangement is provided so that the count value data delivered from the counting circuit 120, i.e. time data, which is supplied to the synthesizing circuit shown in FIG. 2 is detected from the synthesizing circuit 122 for an event, and said count value data or time data, jointly with the note pitch data corresponding to such event, forms a performance data. This performance data is formed for each channel by a performance data forming circuit 221. More particularly, a performance data which is of the concentrated form containing the time data of depression-and-release of a key during a key operation on the player piano 211, along with the note pitch data at the time of the key depression, is generated so as to correspond to the respective channels, and the data in the respective channels are stored and set sequentially in a memory 222.

The performance scene of the group 211 of musical instruments including the player piano 211*a* is photographed by a video camera 223 to be formed as an image information, and concurrently therewith the sound of performance of the group 211 of musical instruments excluding at least the performance sound of the player piano 211*a* itself is detected in, for exmple, two channels. The image information and the 2-channel performance sound information are appropriately modulated and synthesized in a synthesizing circuit 225 to form an image data. This image data is stored and set on an image storing section 226 which is comprised of a recording medium such as a tape, disc or a solid memory.

The performance data which has been stored in said memory 222 and the image data which has been stored in the image storing section 226 are controlled of their read-out in accordance with command signals delivered from a read-out controlling circuit 227. The read-out data as well as the read-out address data delivered from the controlling circuit 227 are supplied to a mixing circuit 228.

FIG. 5 shows a format of a composite video signal which is formed in the mixing circuit 228. Firstly, a performance data is read out from the memory 222 in accordance with a command signal from the read-out controlling circuit 227, which is derived corresponding to, for example, several tens of fields of the video signal. And, correspondingly to the completion of the read-out of this performance data, an image data is read out from the image storing section 226. Then, a composite video signal which is comprised of a continuous performance data and continuous image data is derived from the mixing circuit 228, and is recorded on a video system 229 which utilizes a video tape or a video disc as a recording medium.

Here, as shown in FIG. 5 also, a single line of address data is inserted in the blanking portion which is located at the tailing edge of the vertical (V) synchronization signal. This address data designates the start address and the stop address of both the performance data and the image data. And, the performance data is preliminarily stored in the memory 322, and is caused to be outputted by the address data in synchronism with the video data.

FIG. 6 shows the reproducing section from the video unit 229 in which has been recorded a composite video signal having such format as shown above. This signal reproduced from the video system is supplied to a separating circuit 230, and the performance data which has been recorded for the initial plurality of fields is supplied to a performance data reproduction storing circuit 231. And, an image data following this performance data is further supplied to a separating circuit 232 to be separated into an image information and a 2-channel performance sound signal. The image information is reproduced as an image on a monitor screen 233, while the performance sound signal is stereophonically reproduced as a high quality sound through a 2-channel speaker system comprising loudspeakers 234*a* and 234*b*.

In the above-mentioned instance, the whole apparatus is operated in such way that, the address data which is inserted correspondingly to the vertical synchronism is separated and extracted in the separating circuit 230 to drive a read-out controlling circuit 235 so that the performance data is reproduced and read out from the performance data reproduction storing circuit 231 in synchronism with the reproduction of the image and the sound to drive the player piano 211*a*, so as to directly derive a performance sound from this piano 211*a*. That is, the image of the performance scene is displayed on the monitor screen 233, and concurrently therewith the accompanying performance sound by the group 211 of musical instruments is reproduced stereophonically in high quality through the speaker system 234*a* and 234*b*, and in synchronism therewith the player piano 211*a* will be plunged into automatic playing. Accordingly, along with the reproduced sound from the speaker system 234*a* and 234*b*, the direct performance sound of the player piano 211*a* can be heard. Thus, a performance scene which is quite realistic can be reproduced. This can be utilized most effectively in musical education also.

It should be understood that, in this instant embodiment also, it is possible to form an information of a music score by "TELOP" based on the performance data which is read out from the performance data reproduction storing circuit 231, and to display it also on the monitor screen 233. In this instance, if the automatic playing mode of the player piano 211*a* is suspended so as to actually play the piano by the listener-watcher in accordance with the indications on the music score displayed on the monitor screen 233, it is possible to achieve a high-degree effect of piano playing exercise.

Figure 7:
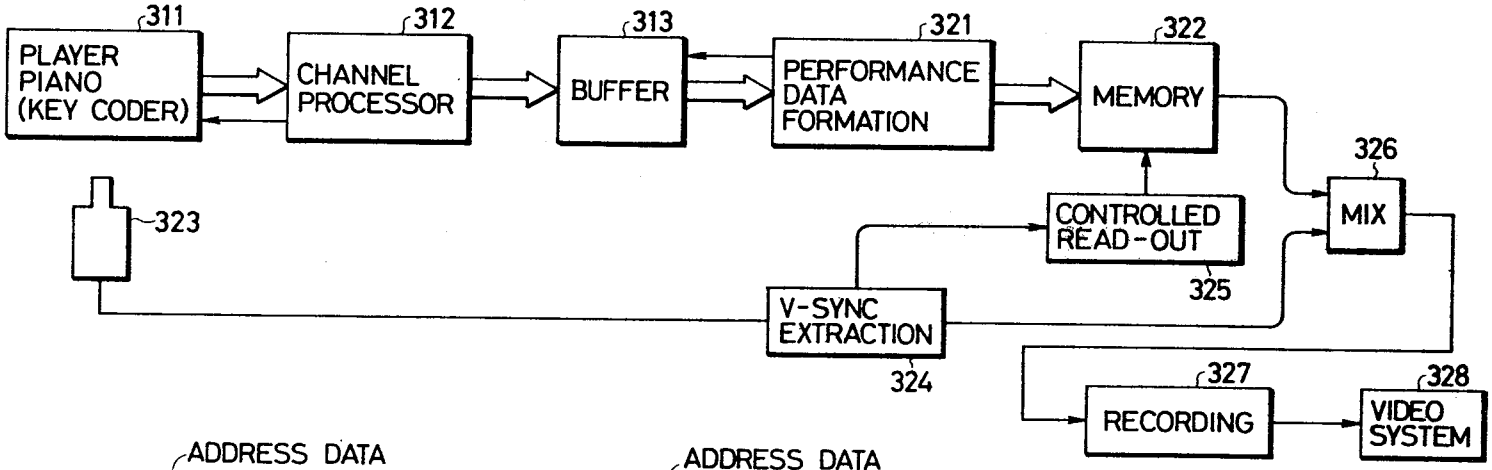
FIG. 7 is a block diagram showing the arrangement of the recording section of the apparatus for recording and reproducing a performance according to still another embodiment of the present invention.
Figure 8:
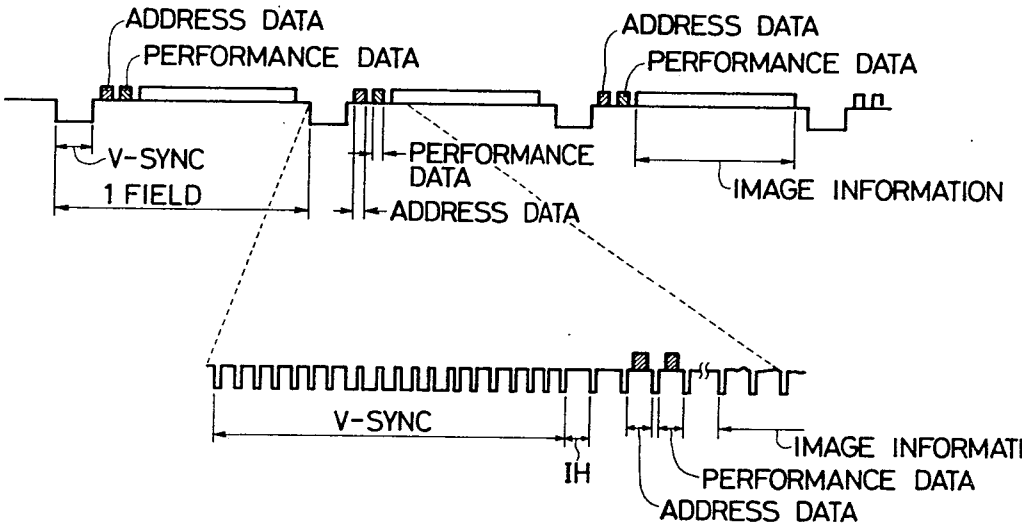
FIG. 8 is a chart for explaining the format of a mixed image signal which is formed by the recording section shown in FIG. 7.
Figure 9:
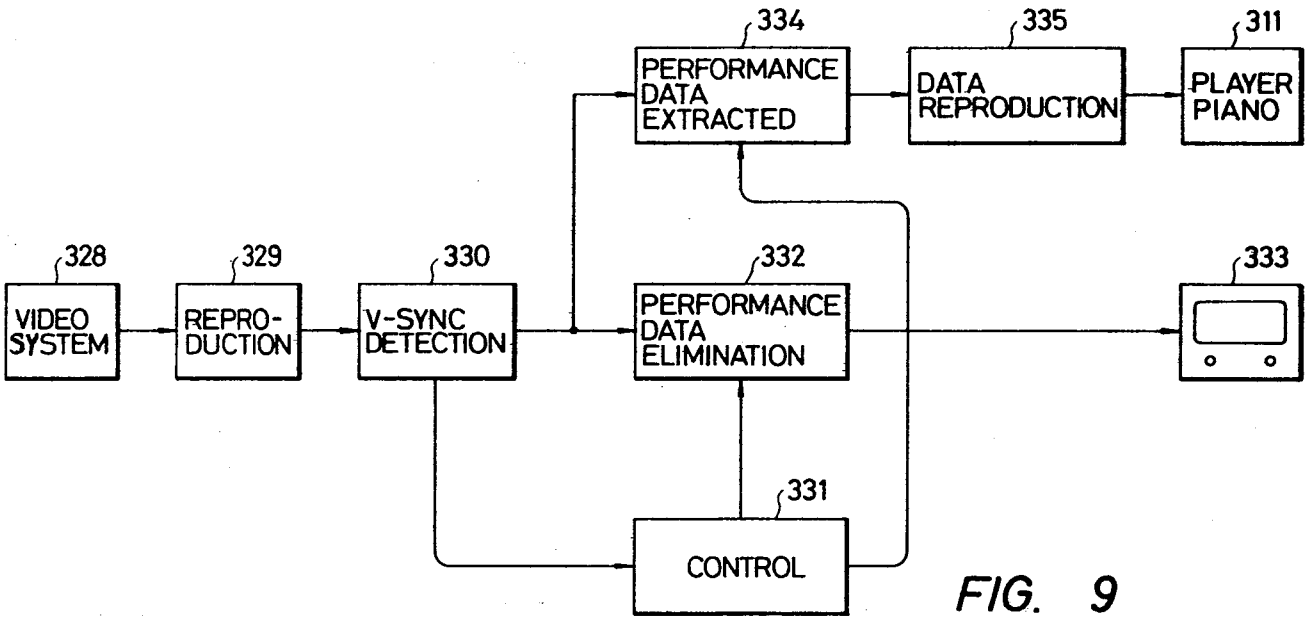
FIG. 9 is a block diagram for explaining the reproducing section for effecting a reproduction based on the mixed image signal depicted in FIG. 8.

FIGS. 7 to 9 show still another embodiment of the apparatus for recording and reproducing a performance according to the present invention. It should be understood that this embodiment concerns the recording and reproduction of only the scene of performance and the performance data of a player piano alone.

The arrangement and the operation of items, i.e. the player piano 311, the channel processor 312, the buffer 313, the performance data forming circuit 321 and the memory 322 are substantially the same as those of the player piano 211*a*, the channel processor 212, the buffer 213, the performance data forming circuit 221 and the memory 222 shown in FIG. 4, and therefore their explanation is omitted.

Here, each performance data is comprised of digital data. For example, a note pitch data is comprised by a 2-bit octave data and a 4-bit note (note name) data. The data for each channel is formed by, for example, a time data between events and by a note pitch data in an extent of time following an event (it should be understood that there is present no performance sound for the extent of time following an event created by a release of a key, and that accordingly the note pitch data following such event is invariably a zero "0" note pitch data).

The performance scene on the player piano 311 is photographed by a video camera 323, and its image signal is led to a vertical (V) synchronizing signal extracting circuit 324. The vertical synchronism signal extracted by this circuit 324 drives a read-out controlling circuit 325 and reads out from a memory 322 a performance data in correspondence to the blanking period of the vertical synchronizing signal, and it is mixed at a mixing circuit 326 with an image signal which has been transmitted through the vertical synchronism signal extracting circuit 324.

Here, the format of the mixed image signal in which the performance data has been mixed by the mixing circuit 326 is provided in such form as shown in FIG. 8. The performance data is mixed in such way as to be set on a single line or on several lines while avoiding the address information line, during the blanking period corresponding to the vertical (V) synchronizing signal as shown in an enlarged style in FIG. 8. That is, the performance data is inserted in synchronism with the image information so as to enable a real time processing. "1 H" represents one horizontal scanning period. Accordingly, the number of sampling of the performance data will become 60 Hz. That is, the sampling is conducted every 17 msec. As such, it is possible to insert performance data for 4 samplings, representing the sampling done every 4 msec in correspondence to one vertical synchronization.

And, the composite video signal such as shown in FIG. 8 which is thus obtained in the mixing circuit 326 is recorded by a recording controlling circuit 327 on a video system 328 which uses a video tape or a video disc as the recording medium.

FIG. 9 shows a reproducing section of the composite video signal which is video-recorded as described above. The composite video signal which is reproduced from the video unit 328 by a reproducing circuit 329 is detected of its vertical synchronizing signal by a vertical synchronism detecting circuit 330, and a controlling circuit 331 is driven by this detected vertical synchronizing signal. In this controlling circuit, the performance data is eliminated from the composite video signal by a performance data eliminating circuit 332, and the image which has been photographed by the video camera 323 is reproduced by a CRT monitor 333. Also, the controlling circuit 331 drives a performance data extracting circuit 334 to extract only the performance data out of the composite signal, and supplies same to a data reproduction driving circuit 335, and drives the player piano 311 based on said performance data, to thereby allow the actual performance sound of this piano 311 to be heard in correspondence to the image from the CRT monitor 333.

That is, while using a video system, the user is able to listen to the actual performance sound of a player piano in synchronism with the reproduced performance scene from the video system. Thus, it is possible to materialize a reproduction of automatic performance of the piano which is quite realistic, unlike the performance sound reproduced through a loudspeaker system.

In the above-mentioned embodiment, description has been made by limiting the musical instrument which is played to a player piano. It should be understood that, in practice, there can be an instance wherein the musical instrument is accompanied by an orchestra performance by a group of other musical instruments.

In such an instance, the performance scene of this group of musical instruments is photographed by the video camera 323, and concurrently therewith the performance sound of other musical instruments excluding the performance sound of the player piano 311 is collected stereophonically by a 2-channel microphone system. The 2-channel performance sound signal is modulated appropriately as in the conventional video system, and is recorded on a video system together with the image signal. And, at the time of reproduction, the performance sound of the group of musical instruments is reproduced with high quality through, for example, a 2-channel speaker system in such way that this reproduced sound is combined with the actual performance of the player piano 311, whereby it is possible to materialize a more effective reproduction mode of a music which is accompanied by a visualized image of the performance of the group of musical instruments.

It is to be understood here also that the performance data which is extracted from the composite video signal can be substituted by a "TELOP" data of a score form for being displayed on the CRT monitor 333.

What is claimed is:

1. An apparatus for recording and reproducing a musical performance, comprising:

a recording section including a video system for recording in a composite form (a) an image signal obtained by photographing a scene of a performance of musical instruments, (b) a sound signal obtained by detecting a performance sound of said musical instruments, said sound signal substantially excluding the sound of a certain musical instrument, and (c) digital performance data indicative of the performance of said certain musical instrument; and a reproducing section for separating the recorded image signal, sound signal and performance data relative to each other by a reproduction of the record obtained by said video system, and for reproducing an image from the separated image signal, and a sound from the separated sound signal, and for using said performance data to drive an automatically playing musical instrument corresponding to said certain musical instrument to make an automatic real performance based on said performance data.

2. An apparatus according to claim 1, in which:

said reproducing section comprises means for displaying by a television opaque projecting (TELOP) technique a musical score based on said performance data, together with an image from said image signal.

3. An apparatus according to claim 2, in which:

said reproducing section comprises means for inhibiting the driving of said automatic playing musical instrument when said TELOP of musical score is being displayed.

4. An apparatus for recording and reproducing a musical performance, comprising:

means for photographying a scene of performance of musical instruments to form an image signal;

means for detecting a performance sound of said musical instruments to form a sound signal;

means for detecting a performance information of a certain musical instrument to synthesize this information with said image signal and said sound signal;

a video system for recording and reproducing said image signal and said sound signal;

means for reproducing an image from said image signal delivered from said video system;

means for reproducing a sound from said sound signal; and at least one automatic playing musical instrument corresponding to said certain musical instrument for extracting a performance information having been synthesized with said image signal and said sound signal and for being driven to make an automatic playing based on the extracted performance information.

5. An apparatus according to claim 4, in which:

said means for forming a sound signal comprises a microphone for detecting, stereophonically in two channels, a performance sound of said musical instruments by eliminating the performance sound of said certain musical instrument.

6. An apparatus according to claim 4, in which:

said certain musical instrument is a player piano which generates a plurality of note pitch data by virtue of its performance made as it is actually played by a person.

7. An apparatus according to claim 6, in which:

said note pitch data is formed by a combination of an octave code and a note (note name) code and is generated in digital form.

8. An apparatus according to claim 6, in which:

said means for detecting the performance information of said certain musical instrument and for synthesizing this performance information with an image signal and a sound signal comprises:

key coder means to detect said plurality of note pitch data respectively;

channel processor means for assigning the respective note data to plural channels therefor;

buffer memory means for storing the note pitch data for the plurality of channels derived by said channel processor means;

performance data forming circuit means for forming a performance information based on the note pitch data stored in said buffer memory means; and mixing circuit means for mixing, into a signal, the performance information from said performance data forming circuit means, with said image signal and said sound signal.

9. An apparatus according to claim 8, in which:

a portion each of said channel processor means and said buffer memory means corresponding to a single channel comprises:

means for generating a timing data;

means for detecting an event based on said note pitch data to generate an event detection signal; and means for synthesizing said note pitch data and said timing data in accordance with said event detection signal to form a performance information.

10. An apparatus according to claim 8, in which:

said performance data forming circuit means outputs, sequentially in the order of the channels, the performance information supplied from each of said plurality of channels.

11. An apparatus according to claim 9, in which:

said means for generating an event detection signal comprises:

first shift register means driven by a first clock pulse to store, in accordance therewith, a note pitch data which is then applied to its input, and to output its stored contents;

second shift register means driven by said first clock pulse to store, in accordance therewith, an output of said first register means, and to output its stored contents; and logic circuit means for judging, for each arrival of said first clock pulse, a change in the note pitch data based on the respective outputs of said first and second shift register means, and for detecting an event based on said judgement.

12. An apparatus according to claim 5, in which:

said means for reproducing a sound is comprised of a two-channel speaker system.

13. An apparatus for recording and reproducing a musical performance comprising:

at least one musical instrument generating a performance data in accordance with a manual playing thereof;

means for photographying a scene corresponding to a musical performance of said musical instrument;

means for storing, in digital form, a performance data accruing from a performance of said musical instrument;

means for extracting a vertical synchronizing signal from an image signal of a photographed image to effect a controlled read-out of the stored performance data in correspondence to said vertical synchronizing signal;

means for synthesizing the thus readout performance data at a blinking portion of said image signal corresponding to said vertical synchronizing signal to form a composite video signal;

a video system for recording said composite video signal; and an automatic playing musical instrument driven to effect a performance based on the performance data extracted from said blanking portion when a reproduction is made by said video system.

14. An apparatus for recording and reproducing a musical performance, comprising:

an automatic playing musical instrument generating a performance data in accordance with a manual playing thereof, said performance data being digital and including played note timing information;

means for photographing a scene corresponding to a performance of said musical instrument;

means for storing said performance data and also an image signal comprising video information of said photographed performance scene;

means for forming a composite video signal including both said digital performance data and said image signal and for recording this composite signal;

means for separating said performance data out of said recorded composite signal and for storing same;

means for effecting a controlled read-out of the stored performance data in synchronism with a reproduction of the image signal from said composite video signal, and means for operating either the same or another automatic playing musical instrument to obtain a controlled performance based on the performance data this read out.

* * * * *